United States Patent [19]

Morizot

[11] Patent Number: 5,031,118

[45] Date of Patent: Jul. 9, 1991

[54] APPARATUS AND METHOD FOR ADAPTING MULTIPLE OPERATING MODE MONITOR

[75] Inventor: Gerard Morizot, Villingen, Fed. Rep. of Germany

[73] Assignee: Deutsche Thomson-Brandt GmbH, Villingen-Schwenningen, Fed. Rep. of Germany

[21] Appl. No.: 332,847

[22] PCT Filed: Jul. 1, 1988

[86] PCT No.: PCT/EP88/00581

§ 371 Date: Mar. 1, 1989

§ 102(e) Date: Mar. 1, 1989

[87] PCT Pub. No.: WO89/00325

PCT Pub. Date: Jan. 12, 1989

[51] Int. Cl.[5] ..... G09G 1/00

[52] U.S. Cl. ..... 364/521; 340/732

[58] Field of Search ..... 364/518, 521, 523; 358/148, 149; 340/732, 789, 790, 716, 743; 315/364, 367

[56] References Cited

U.S. PATENT DOCUMENTS 4,800,429 6/1989 Perkins ..... 358/148
4,847,539 7/1989 Kim ..... 340/739

FOREIGN PATENT DOCUMENTS 0103982 7/1983 European Pat. Off. ..... 364/521

OTHER PUBLICATIONS

IBM Technical Disclosure Bulletin, vol. 24, No. 9, Feb. 1982, pp. 4680–4687 by Dunik, Title "Raster Scan Display Sync Gen.".

IBM Technical Disc. Bul., vol. 28, No. 6, Nov. 1985, pp. 2615–2620, Title "Video Compatibility Feature".

*Primary Examiner*—Arthur G. Evans
*Attorney, Agent, or Firm*—Joseph S. Tripli; Joseph J. Laks; Harvey D. Fried

[57] ABSTRACT

An adapter for a multiple operating mode monitor automatically controls the horizontal and vertical deflection circuits of the monitor cathode ray tube depending upon the characteristics of the video source to which the monitor is connected. The adapter has a digital memory for storing sets of monitor operating parameters for each of a plurality of predetermined operating modes at selectively addressable locations. A processor evaluates horizontal and vertical synchronizing signals from a video source to which the monitor is connected to identify one of the plurality of predetermined operating modes corresponding to the synchronizing signals. The operating mode may be evaluated and identified by measuring the period of the horizontal and vertical synchronizing signals form the video source. The memory location corresponding to the identified mode of operation is selectively addressed, the selected set of operating parameters, which may be in parallel format, being available as an output to a plurality of dynamic digital to analog converters. The digital to analog converters, which may be synchronized with the vertical frequency, provide analog control signals for the horizontal and vertical deflection circuits. The horizontal and vertical deflection circuits are adjusted responsive to the analog control signals to correspond to the selected set of operating parameters. The operating parameters may include horizontal and vertical frequency, horizontal and vertical amplitude, horizontal and vertical deflection phase position, brightness and contrast.

24 Claims, 2 Drawing Sheets

APPARATUS AND METHOD FOR ADAPTING MULTIPLE OPERATING MODE MONITOR

The variety of different personal computers and monitors has resulted in the creation of many different operating modes for the input signals required by the monitors. Until now, it has been impossible to operate any given monitor with another personal computer without special adaptation. Rather, a specific adapter board had to be used for each operating mode. The operating modes can be distinguished mainly on the basis of their line frequency, picture frequency, the number of scan lines and the horizontal and vertical amplitude, as well as their formats usable within the screen format.

It is an aspect of the invention to provide a method by means of which the signal of the personal computer designated for the monitor may be evaluated for characteristics specific for the computer's operating mode, to initiate an automatic adaptation of the monitor to the identified operating mode.

This aspect of the invention may be achieved by a method for adapting a multiple mode monitor to a plurality of video sources having different operating parameters. A first step may be storing sets of monitor operating parameters for each of a plurality of operating modes at selectively addressable locations. A second step may be evaluating horizontal and vertical synchronizing signals from a video source to which the monitor is connected to identify one of a plurality of predetermined operating modes corresponding to the synchronizing signals. A third step may be selectively addressing the set of operating parameters corresponding to the identified operating mode. A final step may be adjusting operation of the monitor, for example, the horizontal and vertical deflection circuits, to correspond to the selected set of operating parameters. The synchronizing signals may be evaluated by measuring the respected periods of the synchronizing signals. A time base may be derived from the vertical synchronizing signals for measuring the period of the horizontal synchronizing signals. The operating parameters may be stored as digital data and converted to analog control signals by dynamic digital-to-analog conversion. The dynamic digital-to-analog conversion may be synchronized with the vertical frequency. The number of steps in the digital-to-analog conversion for each period of the vertical synchronizing signal may be held to a constant number of steps.

In accordance with an inventive aspect of the invention, the ratings or operating parameters of frequently occurring operating modes are stored in a memory. This may be done, for example, by prior adjustment with test signals. After the termination of testing, the parameters so obtained may be written into the memory designated for this purpose, for example, a read only memory. The ratings are stored under addresses specific for the operating modes. After selection of one of the addresses, all required ratings will be present at the output of the memory. If it is possible to definitely deduce the operating mode by evaluation of the horizontal and vertical synchronizing signals of the personal computer, the address allocated to this operating mode can be called, and the operating mode can be set. The operating mode is set by feeding signals from the memory output to the horizontal and vertical scanning stage of the monitor. This stage includes the horizontal and vertical deflection circuits. As the setting occurs immediately after the reception of horizontal and vertical synchronizing signals, the time required for setting can barely be noticed by the user. It is even possible to switch a monitor in operating to another personal computer, without the need to consider whether the other personal computer uses the same or another operating mode. The number of possible operating modes which can be set automatically under the invention is unlimited in principle. In practice, however, it is dependent on the size of the memory which is used for storing the parameters or ratings.

In accordance with another aspect of the invention, it is also possible to distinguish those operating modes that coincide in one of the values by evaluating both the horizontal and the vertical synchronization signals, as done in a further development. In one embodiment the determination of the period or duration of the horizontal synchronizing signals may be determined by measuring several periods and dividing by the number of synchronizing signals. In this way it is possible to obtain a high degree of measuring accuracy in spite of the clock pulse frequency of the microprocessor being within the same range as the horizontal frequency, without the need for additional circuits.

It is especially advantageous to run the control signals for the horizontal and vertical scanning stages of the monitor through dynamic digital-to-analog converters because triggering via the serial output of a microprocessor becomes possible. The disadvantage normally entailed in these kind of digital-to-analog converters, namely that deviations of the horizontal or vertical frequency from the conversion frequency cause a flicker or an unevenly bright picture, can be overcome. In accordance with yet another aspect of the invention, the dynamic digital-to-analog converters are synchronized with the vertical frequency, for example, by observing a constant number of steps in every period.

A video test signal is advantageously used to make it possible at the first setting of ratings, or at putting the multiple operating mode monitor into use, to obtain an exact setting which will not have to be later corrected. Thus, it is certain that the whole dynamic function of the analog-to-digital converters are utilized. The video test signal is mainly used for adjustment of the amplitude and phase of the horizontal and vertical deflection. A test signal of a simple design is sufficient for this purpose. It is only important that the respective markings are created at exactly defined times so that a correlation between the test signals visible on the screen and the reference of the ratings is established.

It is particularly simple to create test signals in the form of bars which mark the horizontal and vertical borders of the usable screen area. Additional bars may be created for the adjustment of the geometry. In order to accomplish this by a microprocessor which is also used for other purposes, the video test signals are created as a serial data flow and drawn from a serial output of a microprocessor. The data flow may be generated by a shift register which has previously been loaded in a subroutine according to the designated picture pattern and is triggered after interruption of a main program. The normal program can then be continued during the serial data flow. It is sufficient to trigger the video signal anew in a subroutine loop periodically after each horizontal synchronizing signal.

It is still another aspect of the invention to provide an apparatus adapting a multiple operating mode monitor to a personal computer.

In this respect, it is also an aspect of the invention to automatically set one of several recurrent operating modes by evaluating the characteristics of the signal coming from a personal computer designated for the monitor.

In accordance with this aspect of the invention, an adapter for controlling a multiple operating mode monitor may comprise a memory for storing sets of monitor operating parameters for each of a plurality of operating modes at selectively addressable locations. A processor may be provided for evaluating horizontal and vertical synchronizing signals from a video source to which the monitor is connected to identify one of a plurality of predetermined operating modes corresponding to the synchronizing signals. The memory location corresponding to the identified mode of operation may be selectively addressed, the selected set of operating parameters being available as an output to a plurality of dynamic digital-to-analog converters. The digital-to-analog converters, which may be synchronized with the vertical frequency, provide analog control signals for the horizontal and vertical deflection circuits. The horizontal and vertical deflection circuits are adjusted responsive to the analog control signals to correspond to the selected set of operating parameters. The adapter may be incorporated into new multiple operating mode monitors, or may be adapted for retrofitting existing multiple operating mode monitors.

The microprocessor and the memory make it possible to store all necessary parameters for the possible operating modes and are capable of evaluating the horizontal and vertical synchronizing signals of the personal computer as criteria for determining which parameters are to be set. The values for the duration or period of the horizontal and vertical synchronizing signals are stored in a memory and these values are compared with the measured values. In case of a match, storage locations can be addressed which contain the preset parameters. When the storage location is addressed, the preset parameters are triggered into transmitting control signals for setting the parameters in the horizontal and vertical scanning stages of the monitor.

The dynamic digital-to-analog converters which are used according to a further aspect of the invention for conversion of the digital signals into analog signals can be designed very simply and can be connected signal-wise particularly well to microprocessors with a usual single output.

Further aspects of the invention will be apparent from the following description and drawings which illustrate an embodiment of the invention.

Figure 1:
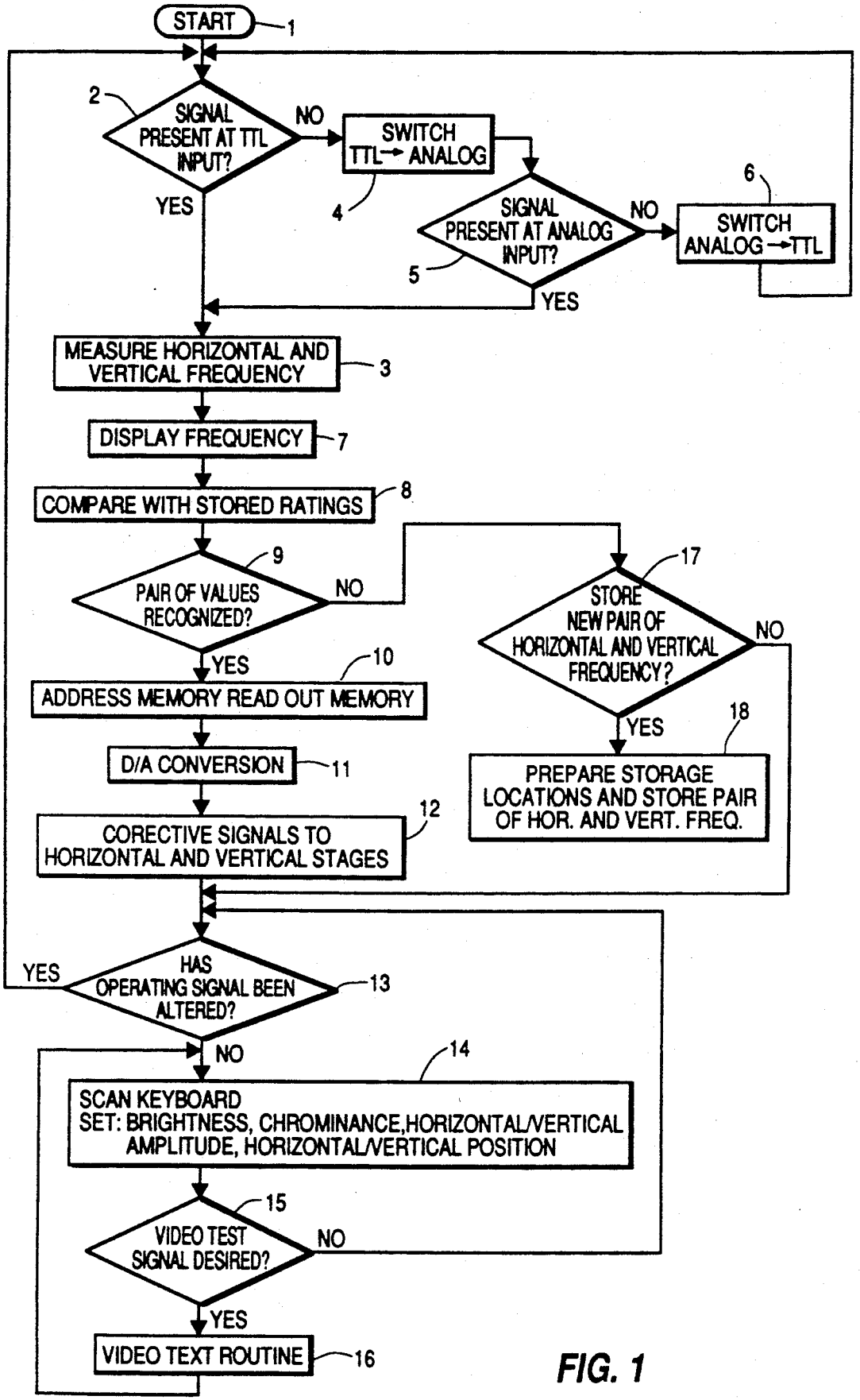
FIG. 1 is a flow chart illustrating a method for operating a monitor with multiple operating modes.

The process shown in FIG. 1 commences at Start 1. After the Start 1, a decision is made in 2 as to whether a signal is being fed to the TTL, or digital, input. If the answer is yes, the process is continued at 3 by measuring the horizontal and the vertical frequency. If the answer is no, the active input is switched over at 4 from the TTL input to the analog input. A check is made at 5 as to whether the signal is now present at the analog input. If the answer is yes, the next step in the process is number 3; if the answer is no, the active input is changed at 6 back over to the TTL input from the analog input and a jump is made back to the decision at 2.

After measuring the frequencies at 3, the frequency is displayed at 7 and compared to stored ratings or parameters at 8. Step 9 asks whether a pair of ratings has been recognized. If the answer is yes, the respective memories are addressed and the memory contents are read out at 10. After a digital-to-analog conversion of the stored data done at 11, the triggering of the horizontal and vertical stages is done by respective analog corrective signals at 12.

After conclusion of this process step, a scanning 13 is used to check whether the operating signal has been altered. If the answer is yes, the process jumps back to Start 1 and the process steps as described above are executed again. If the operating signal has not been altered, the keyboard is then read at 14 to consider desired values for brightness, contrast, horizontal or vertical amplitude and horizontal or vertical position. Thereafter, step 15 asks whether a video signal is desired. If the answer is yes, a video test routing is called at 16 and a jump is made back to 14 to alter the respective values through the keyboard. If no video test signal is desired, a jump is made back to 13.

If at 9 a pair of ratings is not recognized, the process branches to 17, which asks whether the new pair of horizontal and vertical frequency should be stored. If the answer is yes, the storing and preparation of the storage locations for the scanning stage and the ratings is done at 18. If the answer is no, a jump is made to 13.

Figure 2:
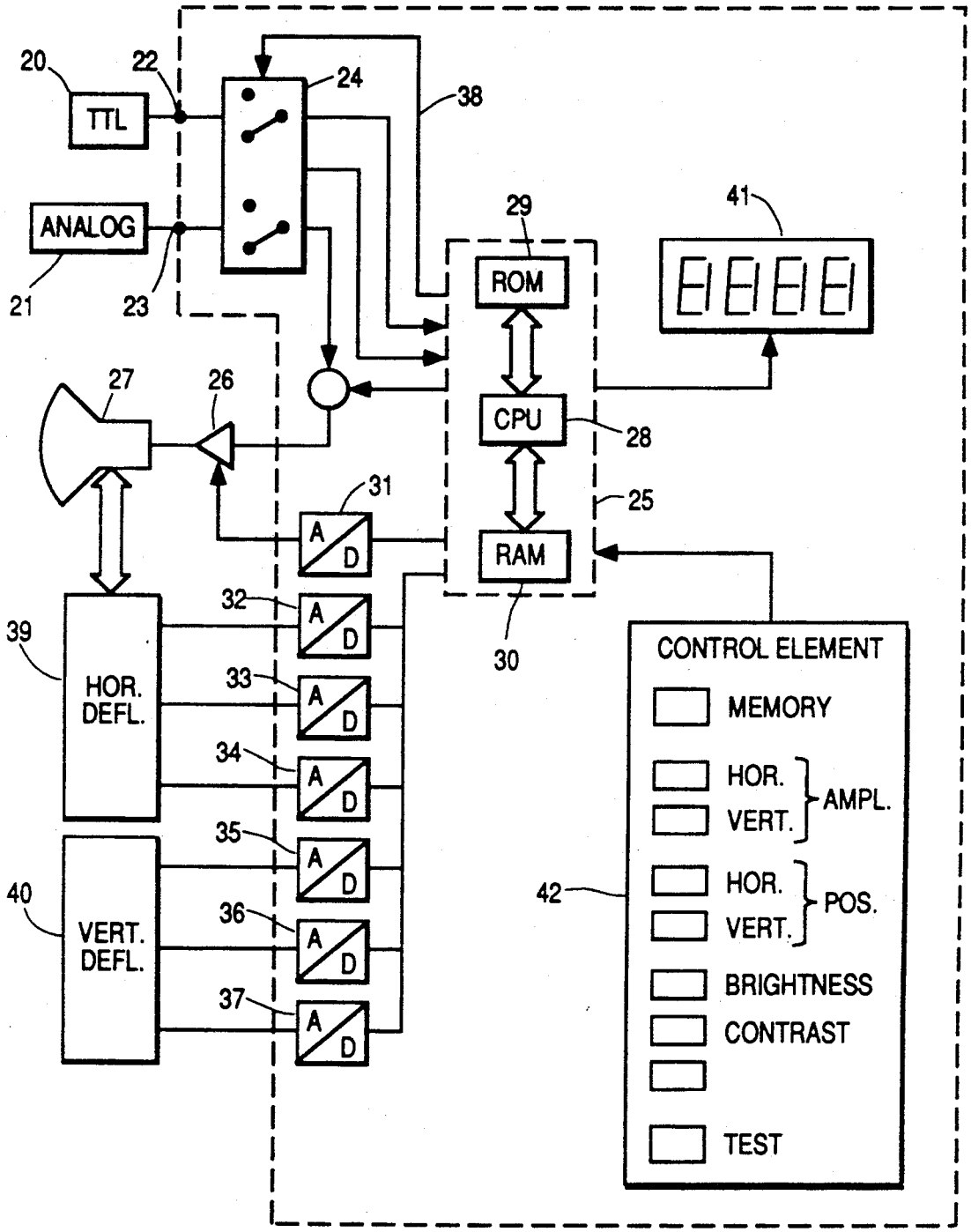
FIG. 2 is a block schematic diagram of a circuit for operating a monitor with multiple operating modes.

An apparatus according to the invention is shown in FIG. 2. Personal computer 20 is equipped with a TTL video adapter board, and personal computer 21 is equipped with an analog video adapter board. The digital monitor signal from personal computer 20 is fed to input 22 at change-over switch 24. The analog monitor signal from personal computer 21 is fed to input 23 of change over switch 23. The signals are fed from change-over switch 24 and a signal conversion circuit to a microcomputer 25. Video parts of the signal are also directly fed to a monitor 27 fed via a video stage 26. A control line 38 runs back from the microcomputer 25 to the change-over switch 24, which makes it possible to alternatively connect digital TTL-signals and analog signals to the microcomputer 25 and the monitor 27. The microcomputer 25 comprises a central processing unit CPU 28, a read only memory ROM 29 and a random access memory RAM 30. Storage locations are available in RAM 30 for several operating modes. These storage locations can be addressed, and the contents of the memory can then be transmitted to the digital-to-analog converters, 31 through 37. The digital-to-analog converters 31 through 37 transmit control signals to a video stage 26 or a horizontal scanning stage 39 or, respectively, a vertical scanning stage 40. A display unit 41 and an input unit 42 are also connected to the microcomputer 25. The input unit 42 enables the horizontal and vertical amplitude, the horizontal and vertical position as well as brightness and contrast to be set. Furthermore, a video test signal can be activated. If storage of a pair of frequency values is desired, this can be stored in the RAM 30 through a storage a storage command key. A personal computer with the respective operating mode can then, on the basis of the pair of values of horizontal and vertical frequency, automatically be adapted to the monitor with respect to the other operating modes.

The signals present at the input of the microcomputer 25 designated for the monitor are evaluated by the microcomputer as to the duration of the period of their horizontal and vertical synchronizing signals. This pair of values is compared to pairs of values stored in the RAM 30. In case of recognition of matching pairs of values, the appropriate storage locations are addressed, and subsequently read out. The stored values representing the respective ratings or parameters are then converted to respective control signals by the digital-to-analog converter 31. Horizontal and vertical frequency is determined by the control signals of digital-to-analog converters 32 and 35 respectively. Horizontal and vertical amplitude is determined by the control signals of digital-to-analog converters 33 and 36, respectively. Finally the phase position of the horizontal and vertical deflection is determined by the control signals of digital-to-analog converters 34 and 37, respectively.

I claim:

1. An adapter for controlling a multiple operating mode monitor, comprising:

a memory for storing sets of monitor operating parameters for each of a plurality of operating modes at selectively addressable locations;

processing means for evaluating horizontal and vertical synchronizing signals from a video source to which the monitor is connected to identify one of a plurality of predetermined operating modes corresponding to the synchronizing signals;

means for selectively addressing the set of operating parameters corresponding to the identified operating mode; and, means for adjusting operation of the monitor to correspond to the selected set of operating parameters.

2. The adapter of claim 1, further comprising a plurality of dynamic analog to digital converters coupled between the adjusting means and horizontal and vertical scanning circuits of the monitor.

3. The adapter of claim 1, wherein each set of the operating parameters comprises information identifying horizontal frequency, vertical frequency, horizontal amplitude and vertical amplitude.

4. The adapter of claim 3, wherein each set of the operating parameters further comprises information identifying horizontal deflection phase position, vertical deflection phase position, brightness and contrast.

5. The adapter of claim 1, wherein the evaluating means and the selecting means are embodied in a microprocessor.

6. The adapter of claim 1, further comprising a further memory for storing evaluation criteria for comparison with the synchronizing signals.

7. The adapter of claim 1, further comprising control means for loading the memory with the sets of operating parameters.

8. The adapter of claim 1, further comprising:

a change over switch having respective inputs for connecting digital and analog video sources to the monitor; and, means for determining which of the inputs is connected to a video source.

9. The adapter of claim 2, further comprising means for synchronizing operation of the digital to analog converters with the vertical frequency.

10. A multiple operating mode monitor, comprising:

a cathode ray tube;

horizontal and vertical deflection circuits coupled to the cathode ray tube;

a digital memory for storing sets of monitor operating parameters for each of a plurality of operating modes at selectively addressable locations;

processing means for evaluating horizontal and vertical synchronizing signals from a video source to which the monitor is connected to identify one of a plurality of predetermined operating modes corresponding to the synchronizing signals;

means for selectively addressing and outputting the set of operating parameters corresponding to the identified operating mode; and, plurality of dynamic digital to analog converters coupled to the addressing and outputting means for converting the operating parameters into analog control signals for the horizontal and vertical deflection circuits; and, means for adjusting operation of the deflection circuits responsive to the analog control signals to correspond to the selected set of operating parameters.

11. The monitor of claim 10, further comprising means for synchronizing operation of the digital to analog converters with the vertical frequency.

12. The monitor of claim 10, wherein each set of the operating parameters comprises information identifying horizontal and vertical frequency, horizontal and vertical amplitude, horizontal and vertical deflection phase position, brightness and contrast.

13. The monitor of claim 10, further comprising:

a change over switch having respective inputs for connecting digital and analog video sources to the monitor; and, means for determining which of the inputs is connected to a video source.

14. The monitor of claim 10, further comprising control means for loading the memory with the sets of operating parameters.

15. A method for adapting a multiple mode monitor to a plurality of video sources having different operating parameters, comprising the steps of:

storing sets of monitor operating parameters for each of a plurality of operating modes at selectively addressable locations;

evaluating horizontal and vertical synchronizing signals from a video source to which the monitor is connected to identify one of a plurality of predetermined operating modes corresponding to the synchronizing signals;

selectively addressing the set of operating parameters corresponding to the identified operating mode; and, adjusting operation of the monitor to correspond to the selected set of operating parameters.

16. The method of claim 15, comprising the step of evaluating the synchronizing signals by measuring the respective periods of the synchronizing signals.

17. The method of claim 16, comprising the step of measuring several periods of the horizontal synchronizing signal and dividing by the number of horizontal synchronizing signals detected.

18. The method of claim 16, comprising the step of deriving a time base from the vertical synchronizing signals for measuring the period of the horizontal synchronizing signals.

19. The method of claim 15, comprising the steps of:

storing the operating parameters as digital data;

dynamically converting the digital data to analog control signals; and, synchronizing the dynamic digital to analog conversion with the vertical frequency.

20. The method of claim 19, further comprising the step of maintaining a constant number of steps in the digital to analog conversion for each period of the vertical synchronizing signal.

21. The method of claim 19, further comprising the step of calibrating the monitor by generating a video test pattern.

22. The method of claim 21, comprising the step of triggering the video test pattern after each horizontal synchronizing signal.

23. The method of claim 21, comprising the step of generating the video test pattern from a serial data stream.

24. The method of claim 19, comprising the step of storing an operating parameter for horizontal and vertical frequency, horizontal and vertical amplitude, horizontal and vertical deflection phase position, brightness and contrast.

* * * * *

UNITED STATES PATENT AND TRADEMARK OFFICE

CERTIFICATE OF CORRECTION

PATENT NO. : 5,031,118

DATED : July 9, 1991

INVENTOR(S) : Gerard Morizot

It is certified that error appears in the above-identified patent and that said Letters Patent is hereby corrected as shown below:

Column 8, line 7, "19" should be --15--.

Signed and Sealed this

Thirteenth Day of October, 1992

*Attest:*

DOUGLAS B. COMER

*Attesting Officer*

*Acting Commissioner of Patents and Trademarks*